US006648457B2

(12) United States Patent
Smith et al.

(10) Patent No.: US 6,648,457 B2
(45) Date of Patent: Nov. 18, 2003

(54) REDUNDANT FLUID INTERCONNECT SEAL FOR A MODULAR INK JET DELIVERY SYSTEM

(75) Inventors: Mark A. Smith, Corvallis, OR (US); Daniel W. Petersen, Philomath, OR (US); David R. Otis, Jr., Corvallis, OR (US); Ralph L. Stathem, Lebanon, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 77 days.

(21) Appl. No.: 10/001,685

(22) Filed: Oct. 31, 2001

(65) Prior Publication Data

US 2003/0081084 A1 May 1, 2003

(51) Int. Cl.[7] ..... B41J 2/175
(52) U.S. Cl. ..... 347/85
(58) Field of Search ..... 347/28, 84, 85, 347/86, 87

(56) References Cited

U.S. PATENT DOCUMENTS

| | | | | | |
|---|---|---|---|---|---|
| 5,495,272 | A | * | 2/1996 | Yamaguchi | 347/28 |
| 5,631,682 | A | * | 5/1997 | Takata | 347/86 |
| 5,828,395 | A | * | 10/1998 | Takata | 347/86 |
| 6,015,209 | A | | 1/2000 | Barinaga et al. | 347/86 |
| 6,019,463 | A | * | 2/2000 | Waseda | 347/86 |
| 6,139,137 | A | | 10/2000 | Stathem et al. | 347/87 |

* cited by examiner

*Primary Examiner*—Anh T. N. Vo

(57) ABSTRACT

A modular ink jet ink delivery system comprising a print manifold including a passageway therethrough for the transfer of ink and a pen tower removably and operatively engageable with the manifold. The pen tower includes a central passageway for receiving and transferring ink from the manifold. A retainer member is operatively connected to the manifold. A first sealing member forms a first seal with the retainer member. A second sealing member forms a second seal with the pen tower such that when the pen tower and the manifold are operatively engaged with each other, a substantially sealed passageway is formed for the transfer of ink from the manifold to the pen tower.

10 Claims, 8 Drawing Sheets

REDUNDANT FLUID INTERCONNECT SEAL FOR A MODULAR INK JET DELIVERY SYSTEM

FIELD OF THE INVENTION

The present invention relates generally to seals for an ink jet ink delivery system. More particularly, the present invention relates to a fluid interconnect seal for a modular ink jet ink delivery system.

BACKGROUND OF THE INVENTION

A typical ink jet printer has a print head mounted to a carriage that is moved back and forth over a print media, such as paper. As the print head passes over appropriate locations on the printing surface, a control system selectively activates the print head to eject, or jet, ink drops onto the print media to form images and text characters.

To work properly, such printers must have a reliable supply of ink for the print head. One type of ink jet printer makes use a disposable ink pen that can be mounted to the carriage. Such an ink pen typically includes, in addition to the print head, a reservoir containing a supply of ink. The ink pen also typically includes pressure regulating mechanisms to maintain the ink supply at an appropriate pressure for use by the print head. When the ink supply is exhausted, the ink pen is disposed of and a new ink pen is installed.

Other types of ink jet printers make use of ink container portions that are separately replaceable from a print head portion. For this type of printing system the print head portion can include a pressure regulating mechanism to maintain proper operating pressure. The ink container portion may be mounted away from the carriage or mounted on the carriage. In either case, it is very important that the replaceable ink container and printer be capable of establishing a reliable fluid connection therebetween. This fluid interconnection should be capable of repeated disconnects and reconnects as the ink container is removed and reinstalled. For the case of ink delivery systems where differential pressure exists between ink passages and atmosphere the fluid interconnect should be robust enough to prevent leakage under normal operating pressures (positive or negative with respect to atmosphere) as well as under various environmental conditions the printer and ink containers are specified to experience either operating or non-operating.

Such an ink jet ink delivery system, also referred to as an IDS, often employs modular designs which frequently contain separate user-replaceable components for the ink supply cartridges and for the print head cartridges. In some designs an intermediate manifold or tubing system is used to transport ink from the ink supply cartridge to a print head cartridge.

Previous fluid interconnect designs have incorporated a single annular compliant face seal around each foam/screen fluid interconnect interface where the manifold connects to the print head cartridge. These seals may be subject to leaks (primarily air leaks). These leaks may especially occur if foreign materials or defects are present at the sealing interface. Air leaks at these interfaces may allow volatile components to evaporate from the ink or even allow the ink within the ink delivery system to dry out completely. Over extended printer usage, a small air leak can allow the print head cartridge to fill with air (as air replaces the ink the print cartridge is attempting to draw). This can cause the print head to deprime and prevent further printing.

SUMMARY OF THE INVENTION

One aspect of the present invention provides for a modular ink jet ink delivery system comprising a print manifold including a passageway therethrough for the transfer of ink and a pen tower removably and operatively engageable with the manifold. The pen tower includes a central passageway for receiving and transferring ink from the manifold. A retainer member is operatively connected to the manifold. A first sealing member is operatively connected to the pen tower and forms a first seal with the retainer member. A second sealing member is operatively connected to the retainer member and forms a second seal with the pen tower such that when the pen tower and the manifold are operatively engaged with each other, a redundantly sealed passageway is formed for the transfer of ink from the manifold to the pen tower.

Another aspect of the invention provides for an ink delivery system comprising an ink reservoir, a manifold assembly including a passageway for receiving and transferring ink from the ink reservoir, and a pen tower removably and operatively engageable with the manifold. A first sealing member is operatively connected to the manifold assembly and forms a first seal with the pen tower when the pen tower is operatively engaged to the manifold assembly A second sealing member is operatively connected to the pen tower and forms a second seal with the manifold assembly when the pen tower is operatively engaged to the manifold assembly.

Another aspect of the present invention provides for a modular ink jet delivery system comprising a manifold including a passageway therethrough for the passage of ink and a pen tower removably and operatively engageable with the manifold, the pen tower including a passageway for receiving and transferring ink from the manifold. A retainer member is fixedly connected to the manifold, and first sealing means are operatively connected to the retainer member. The first sealing means form a seal with the pen tower when the pen tower is operatively engaged with the manifold. Second sealing means are operatively connected to the pen tower. The second sealing means form a second seal with the retainer member when the pen tower is operatively engaged with the manifold, providing for redundant seals along the ink passageway.

DETAILED DESCRIPTION OF THE PREFERRED EMBODIMENTS

The present invention replaces a foam/screen fluid interconnect where a manifold or manifold assembly connects to a print head cartridge with a face seal. The foam/screen interface in previous designs is prone to allow air to be ingested by the ink delivery system if its annular compliant seal is compromised. The impact of air leaks at an ink delivery system sealing interface can be reduced significantly by adding a secondary seal at the interface, especially when the secondary seal is wetted.

Figure 1:
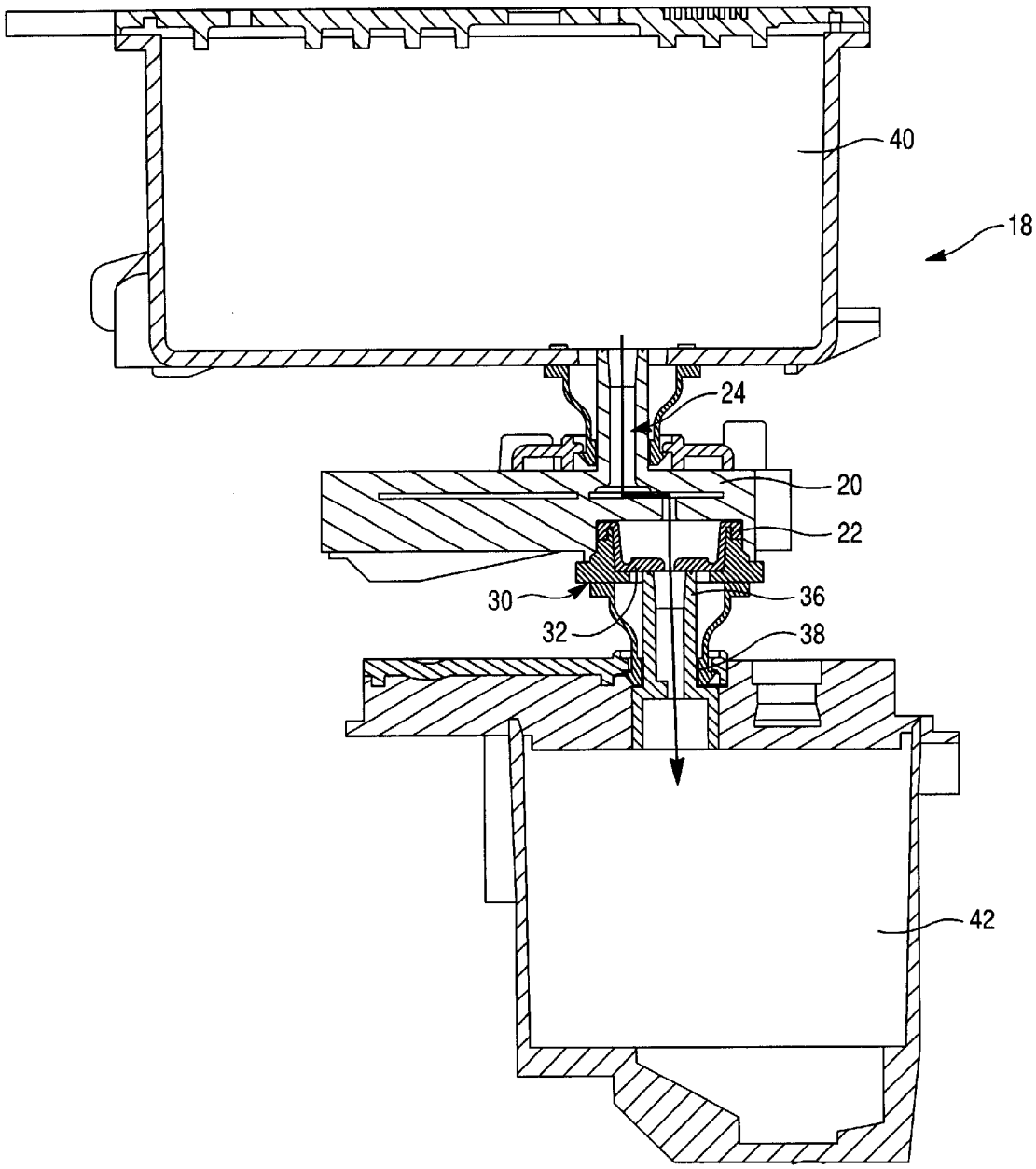
FIG. 1 is a sectional side view of a modular ink delivery system according to one embodiment of the invention.
Figure 2:
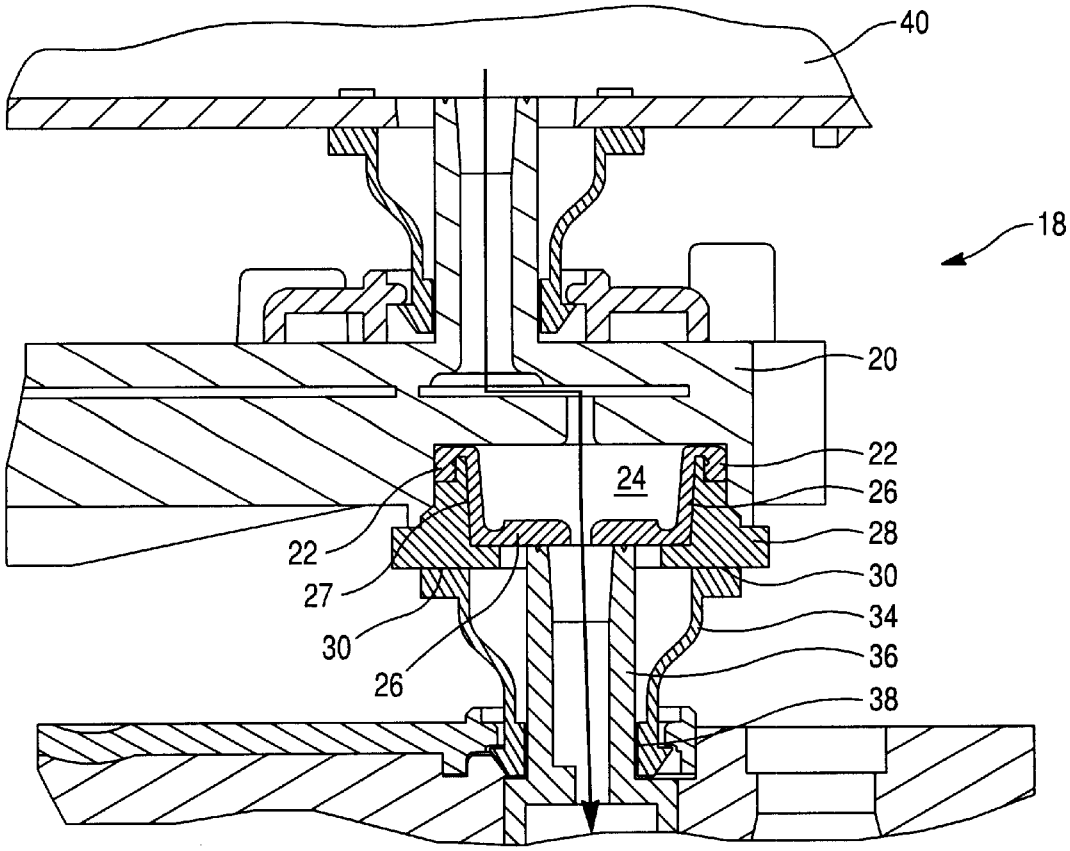
FIG. 2 is an enlarged sectional side view of the ink delivery system of FIG. 1 showing the ink pathway through the system.
Figure 3:
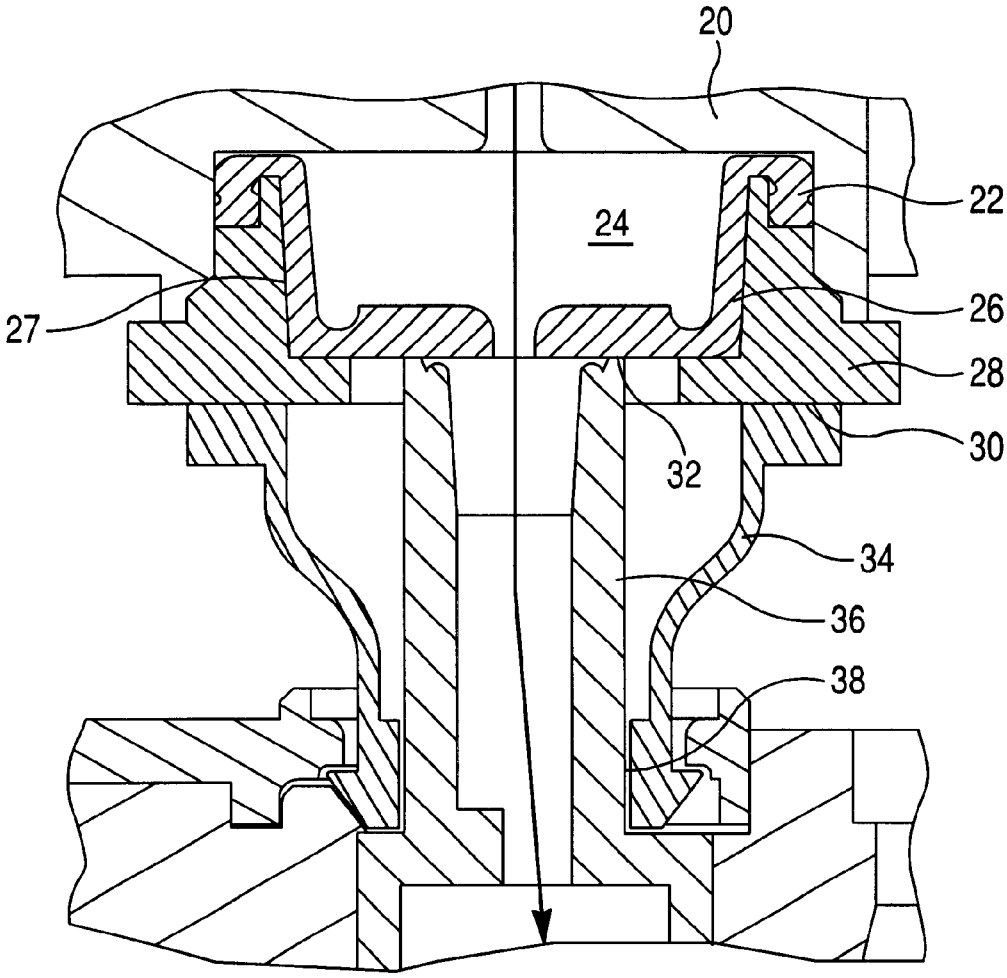
FIG. 3 is a further enlarged sectional and side view of system of FIG. 1.

The present invention can be incorporated into a modular ink delivery system of the type shown in FIGS. 1–3, wherein an ink-routing manifold 20 connects to a pen tower 36 located on a print head cartridge 42. In the ink delivery system, shown generally at 18, an ink supply cartridge or reservoir 40 provides ink, the path of which is shown at 24, through the manifold 20. The manifold 20 routes the ink to the print head cartridge 42. At each of the connections of the ink supply cartridge or reservoir 40 to the manifold 20 and the manifold 20 to the print head cartridge 42, a foam/screen fluid interconnect was previously used. A single annular compliant seal around the foam/screen interface was incorporated to reduce ink evaporation and air gain at these interfaces. This type of system is always under negative pressure relative to atmosphere and so is subject to ingesting air if any leaks in the system exist.

In order to prevent such deleterious occurrences, a redundant inner seal 26 is incorporated with an outer seal 34. The redundant inner seal 26 replaces the foam/screen fluid interconnect with a first face seal 32. When the manifold 20 is brought into contact with the print head cartridge 42, a pen tower 36 is pressed against the exposed face of the inner seal 26, providing the first face seal 32 at this interface. In one embodiment of the invention, the inner seal 26 may comprise an elastomer integrated into the manifold 20 and bound to it by an inner seal retainer 28 which is connected to the manifold 20 to form the manifold assembly (20 and 28) of the modular ink delivery system 18. In one embodiment of the invention, the inner seal retainer 28 is welded to the manifold 20, although other coupling methods may also be used.

A gland-style seal 22 is formed at the interface of the manifold 20 and the inner seal 26, although other sealing methods could also be used without departing from the invention's broader aspects. Once ink is pulled along the pathway 24 and through the manifold 20 to the print head cartridge 42, the first face seal 32 at the inner seal/tower interface becomes wet with ink. This provides a more effective seal than would occur by using a dry face seal. The gland seal 22, although starting dry, may also become a wetted seal.

The outer seal 34 comprises an elastomer installed on the print head cartridge tower 36, forming a radial seal 38 to the tower. The outer seal 34 also provides a second face seal 30 when brought into contact with the inner seal retainer 28. The second face seal 30 may also be made more effective if wetted either by ink or by use of a separate sealant. When the second face seal 30 becomes a wetted seal, this wetted seal will aid with pen air gain in the event that the first face seal 32 or other part of the outer seal 34 is compromised.

In the embodiment shown in FIGS. 1–3, the first and second face seals 30 and 32 are employed to minimize any transverse forces between components of the ink delivery system 18 caused by axial misalignment of the components. Excessive axial or transverse forces on the print head cartridge 42 can affect its alignment relative to the print medium or relative to the other print cartridges in the carriage and therefore adversely affect the resultant print quality. This embodiment also allows the fluid interconnect to be connected and disconnected multiple times without significant performance loss due to aging of the components.

Additionally, the ink delivery system 18 shown in FIGS. 1–3 may include a rolling diaphragm-type seal 27 between the inner seal 26 and the inner seal retainer 28. The rolling diaphragm-type seal 27 operates to minimize forces imparted to the pen while the fluid interconnect is being engaged, thereby helping maintain proper pen alignment with respect to its datum features and not degrading print quality.

In an alternate embodiment of the invention, it may also be possible to use a liquid film, such as a film of polyethylene glycol (PEG), at the first face seal 32 prior to use. The use of such a liquid film can improve the overall sealing effectiveness during the manifold startup process.

Figure 4:
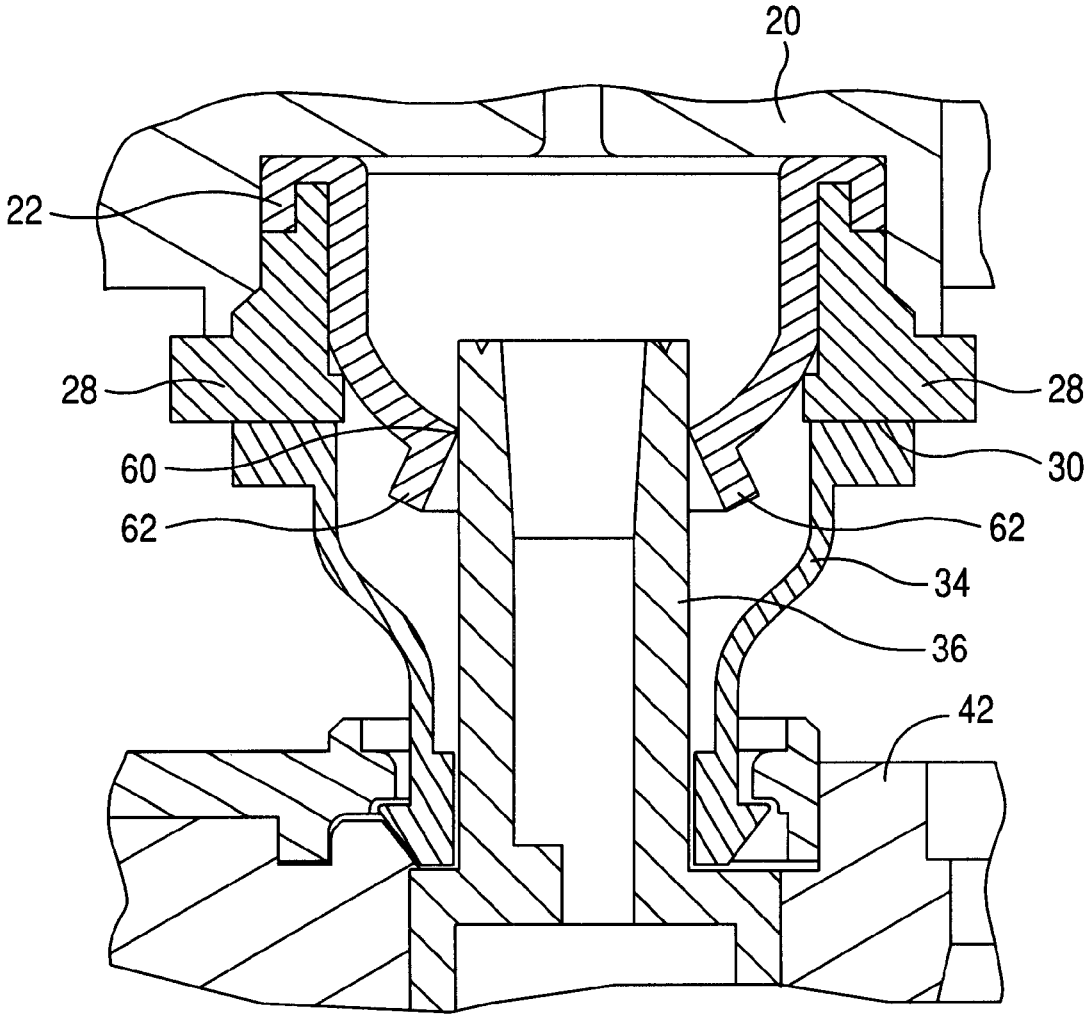
FIG. 4 is a sectional side view of an alternate embodiment of the invention incorporating a radial seal along the outer diameter of the pen tower.

In an embodiment of the invention shown in FIG. 4, a radial seal 60 is formed along the outer diameter of the pen tower 36 and inner sealing material 62. As in the embodiment shown in FIGS. 1–3, the second face seal 30 is formed between the inner seal retainer 28 and the outer seal 34. When the manifold 20 is brought into contact with the print head cartridge 42, the upper portion of the pen tower 36 slides through the radial seal 60. A gland-style seal arrangement 22 is formed at the interface between the manifold 20 and the first face seal 32. Once again, when ink travels through the pathway 24 and is pulled through the manifold 20 to the print head cartridge 42, the radial seal 60 becomes wet with ink, providing a more effective seal than would occur by using a dry face seal.

FIGS. 5–9 show alternate embodiments of the invention. Each of these embodiments show alternative versions of the inner seal 26 of FIGS. 1–4. According to various embodiments of the invention, these different versions of the inner seal 26 of FIGS. 1–4 would be used in addition to the outer seal 34 of FIGS. 1–4 or a similar structure. The examples of seal types shown in FIGS. 5–9 are for illustrative purposes only, and other types of seals could also be used without departing from the invention's broader aspects.

Figure 5:
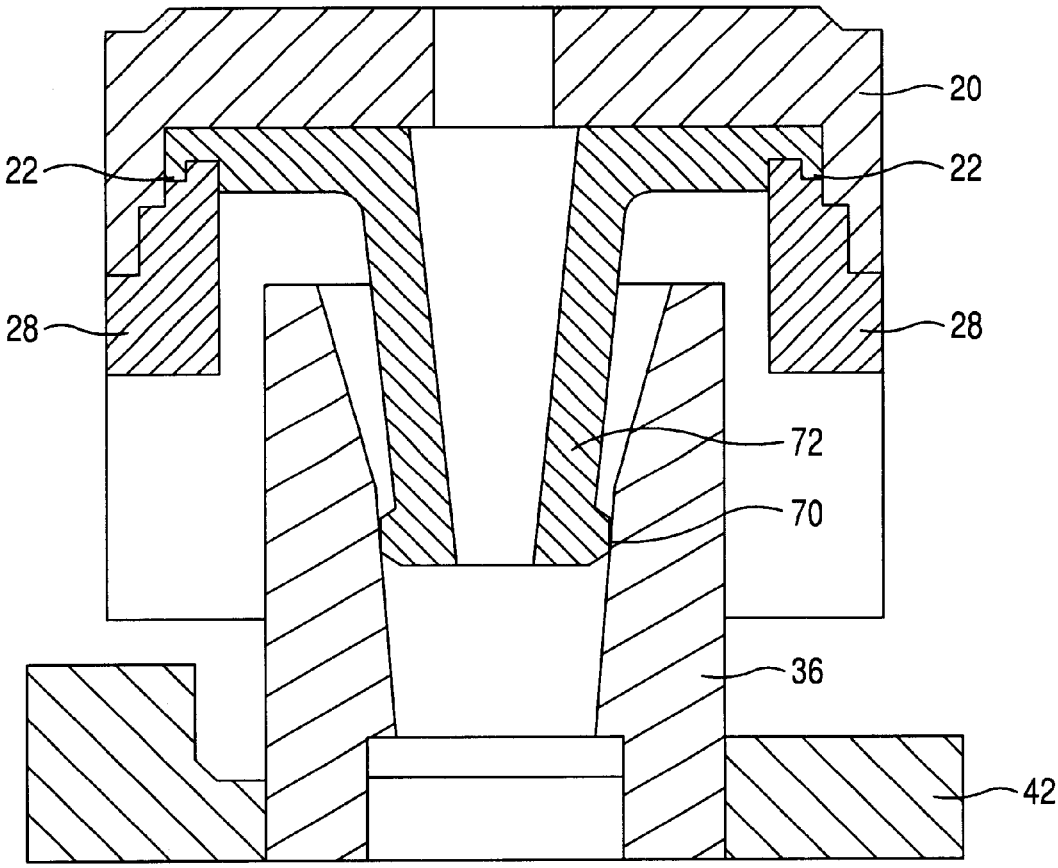
FIG. 5 is a sectional side view of another embodiment of the invention, where a radial seal is formed at the end of a flexible needle along the inner diameter of the pen tower.

FIG. 5 shows another embodiment of the invention, wherein a radial seal 70 is formed along the inner diameter of the pen tower 36 by using a flexible elastomeric material that forms a flexible needle 72. By forming the radial seal 70 inside and along the inner diameter of the pen tower 36, it may be used with or without an outer seal as shown in FIGS. 1–4. When the manifold 20 is brought into contact with the print head cartridge 42, the elastomeric material 72 slides through the inner diameter of the pen tower 36, forming the radial seal 70. In this embodiment of the invention, a gland seal 22 is formed between the inner seal retainer 28 and the elastomeric material 72. It is also possible, however, for the gland seal 22 to be formed between the inner seal retainer 28 and the manifold 20. Once ink is pulled along the pathway 24 and through the manifold 20 to the print head cartridge 42, the radial seal 70 becomes wet with ink. This provides a more effective seal than would occur by using a dry seal. Transverse forces are low because the flexible needle 72 can flex and the seal 70 can pivot. Axial force is minimized because the sealing forces are radial and balance each other.

Figure 6B:
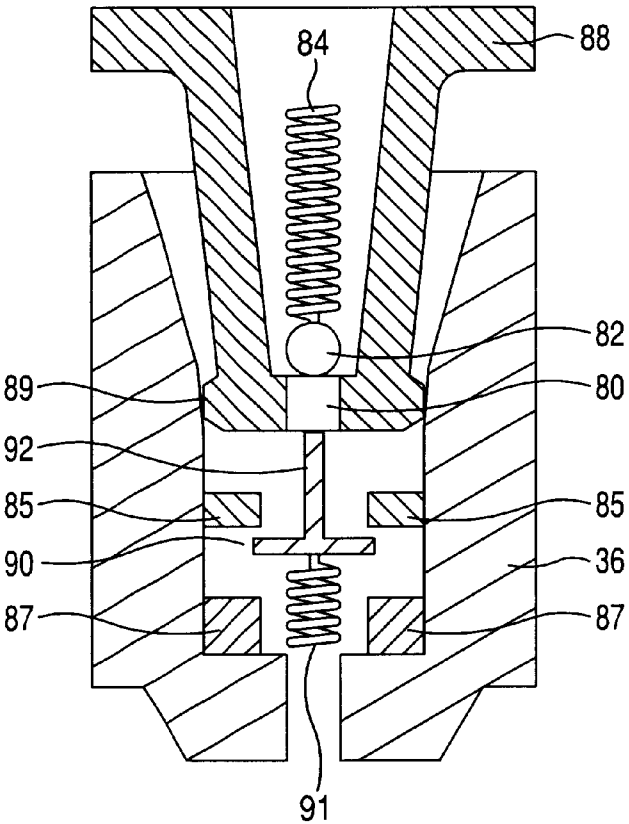
FIG. 6B is a sectional side view of another embodiment of the invention using a flexible needle to form a seal with the inner diameter of the pen tower and includes two check valves that close both the flexible needle and the pen tower when the seal is disengaged.
Figure 6A:
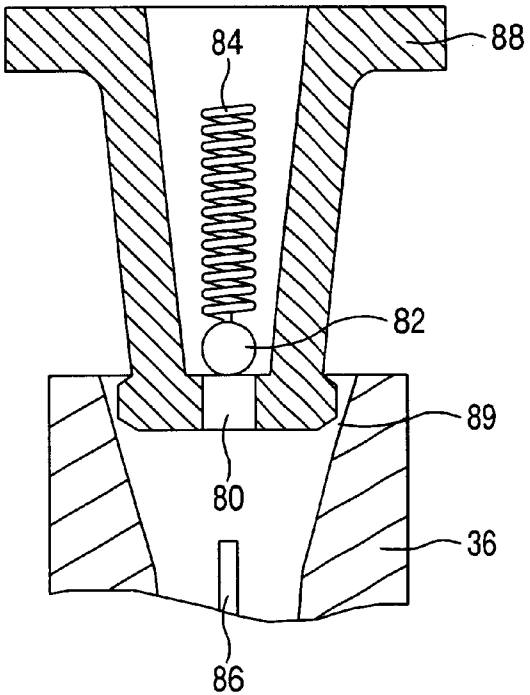
FIG. 6A is a sectional side view of an embodiment of the invention wherein a flexible needle forms a seal with the inner diameter of the pen tower and includes a check valve that closes the flexible needle when the seal is disengaged.

It is also possible to use methods other than face seals or radial seals in accordance with the present invention. For example and as shown in FIGS. 6A and 6B, it is also possible to incorporate a one or two check valves 80 and 90 and flexible needle 88 inside the pen tower 36. The check valves close to reduce ink leakage and air ingestion when the seal is disengaged. In the embodiment of the invention shown in FIG. 6A, a check valve ball 82 is operatively connected to a spring 84, both of which are located generally above a pin 86. The needle 88 is forced into the pen tower 36, causing the pin 86 to press the ball 82 upwards against the spring 84, permitting the ink to flow. The pin 86 actuates the check valve 80, while a seal 89 is formed between the flexible needle 88 and the inner walls of the surrounding pen tower 36. In this embodiment, it is important that the weight of the check valve ball 82 plus the force from spring 84 is enough to overcome any back pressure from the ink supply.

The embodiment shown in FIG. 6B also uses a flexible needle 88 coupled to a check valve ball 82. In this embodiment, however, there is a second check valve 90 comprising a pin 92, a spring 91, and a retainer 85 and ribs 87 positioned within the inner bore of the pen tower 36. The operation of the seal 89 and the check valve 80 is similar to that of the embodiment described in FIG. 6A. However in FIG. 6B, the ball 82 presses on the pin 92 and spring 91 opening check valve 90. Eventually pin 92 contacts ribs 87 and stops moving. Pin 92 now presses the ball 82 upwards against spring 84 permitting ink to flow through check valve 80.

Figure 7A:
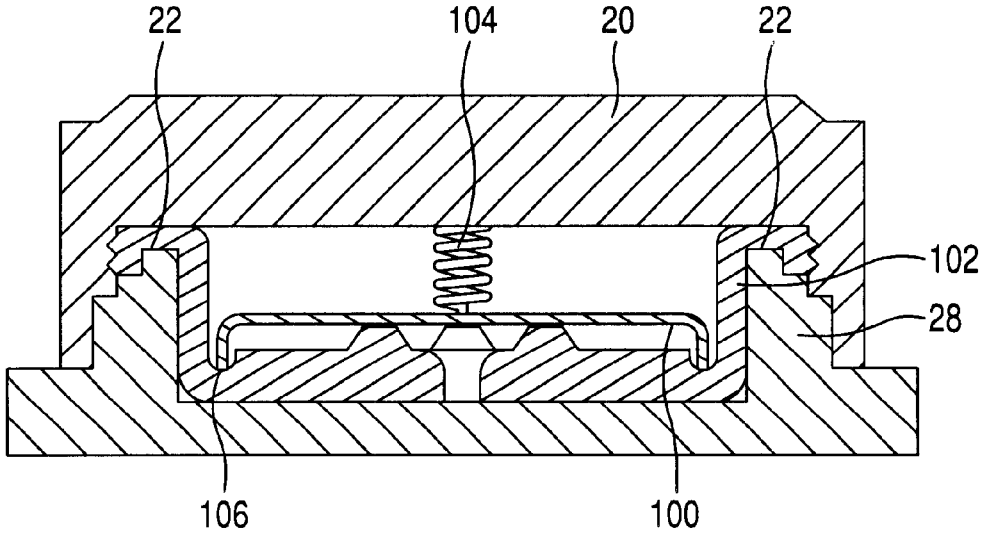
FIG. 7A is a sectional side view of yet another embodiment of the invention using a check valve, wherein the elastomer housing is separated from the pen tower.
Figure 7B:
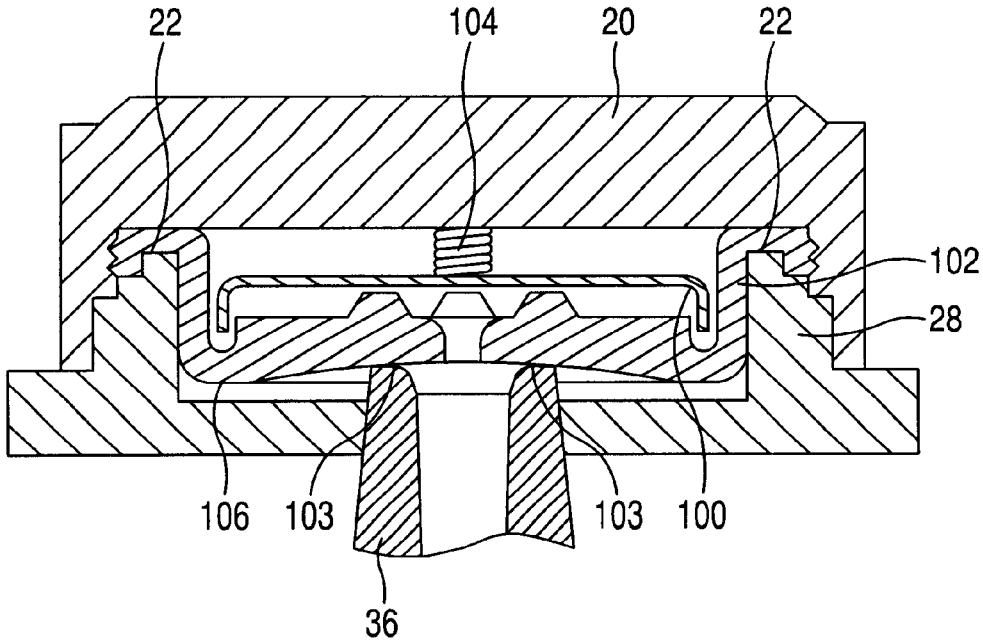
FIG. 7B is a sectional side view of yet another embodiment of the invention using a check valve, wherein the elastomer housing is in contact with the pen tower.

FIGS. 7A and 7B show another embodiment of the invention. In this embodiment, a check valve 100 is placed inside an elastomer housing 102. In one embodiment of the invention, the elastomer housing 102 is similar in structure to the inner seal 26 shown in FIGS. 1–3. A spring 104 is operatively connected to and located generally above the check valve 100. In one embodiment of the invention, the check valve 100 comprises a plastic material, although other types of material may also be used. In this arrangement, when the manifold 20 is separated from the pen tower 36, the use of the check valve 100 limits the degree of back flow. The limitation of the backflow results from the check valve 100 coming into contact with a contact surface 106 on the elastomer housing. The closed position is shown in FIG. 7A. When the manifold 20 comes into contact with the pen tower 36, the elastomer housing 102 deforms, pushing the check valve 100 against the spring 104 and upward relative to the manifold 20. The open position is illustrated in FIG. 7B, which shows an opening for an ink path around the lower edges of the check valve 100 and over the castellations in the upper surface of the elastomer housing 102, i.e., when the manifold 20 is pushed up off the elastomer housing, then the castellations in the elastomer seal allow ink flow when the seal around the perimeter is open. This particular embodiment of the invention also includes the use of a gland seal 22 at the interface between the elastomer housing 102 and the inner seal retainer 28. It is also possible for this gland seal 22 to be formed with the manifold 20, however.

Figure 8:
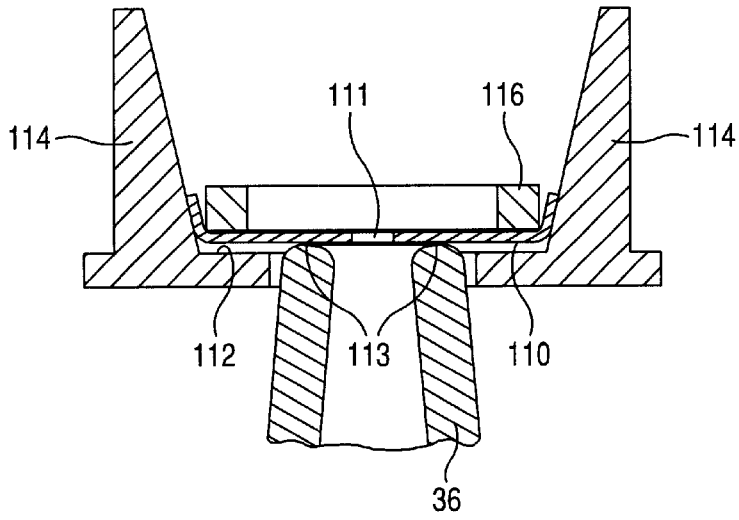
FIG. 8 is a sectional side view of still another embodiment of the invention using an elastomer skin and capture ring for an inner seal.

FIG. 8 shows still another embodiment of the invention. In this particular embodiment, an elastomer washer 110 is located on a contact surface 112 of a foam retainer 114. A capture ring 116 is used to press-fit the outer edge of the elastomer washer 110, forming a seal with the foam retainer 114. The capture ring 116 is machine-formed according to one embodiment of the invention, although other methods of manufacturing the capture ring 116 are also possible. Additionally, it is also possible for the capture ring 116 to be glued to the elastomer washer 110 or for some other bonding method to be used. The pen tower 36 abuts against and partially deforms a portion of the elastomer washer 110 when the print head cartridge (not shown) is connected to the manifold 20. In one embodiment of the invention, the elastomer washer 110 has a central hole 111 with a diameter of about one millimeter, although it is possible for the hole to have a diameter of a different size.

Figure 9:
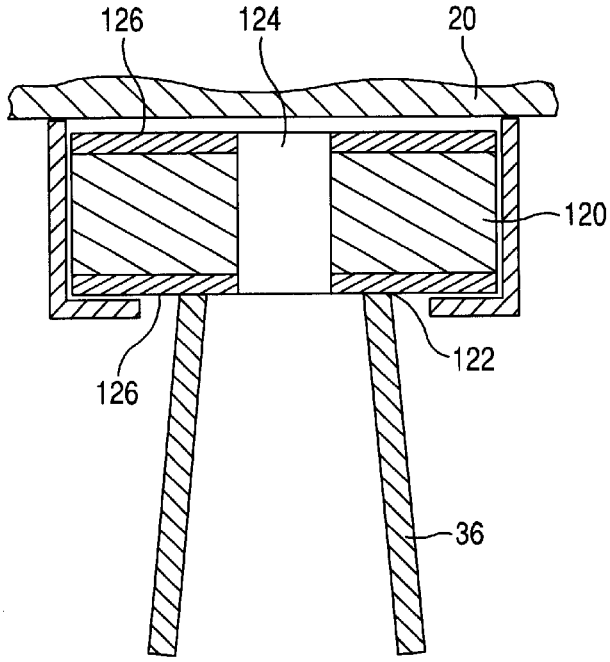
FIG. 9 is a sectional side view of another embodiment of the invention, wherein a compliant disk contacts the pen tower when the pen tower and the manifold are engaged.

Yet another embodiment of the invention is shown in FIG. 9. In this embodiment, a compliant foam disk 120 the pen tower 36 when the pen tower 36 and manifold 20 are engaged. When the pen tower 36 and the manifold 20 are engaged, a seal 122 is formed between the foam disk and the pen tower 36. A small hole 124 is formed through the center of the disk 120. The hole 124 allows for ink and air to flow freely into the pen tower 36. An impermeable skin 126 is located on the top and bottom surfaces of the disk 120. The skin 126 ensures a sufficient bubble pressure so as to prevent air from being ingested from outside the pen tower 36. In one embodiment of the invention, open cell polyurethane foam with a skin of closed cell foam 126 is used to hold ink, to maintain the seal 122, and to provide good compression set characteristics.

Additionally, it should also be noted that ink delivery systems are often shipped dry and primed with ink as the printer is started up. In systems in which ink is pulled through the ink delivery system, an air leak at any of the seals can prevent ink from being pulled from the ink supply cartridge, through the manifold, and into the print head cartridge causing the printer to fail to print. A redundant fluid interconnect seal reduces the possibility of an air leak during startup further ensuring the ink delivery system startup occurs successfully.

Overall print head and printer reliability can be improved by use of redundant fluid interconnect seals rather than a single seal in ink delivery systems in accordance with the present invention where modular ink-handling components are used. Specifically, with a redundant seal the probability of a complete sealing failure at a component-to-component sealing interface becomes the probability of having two seals fail rather than the probability of having a single seal failure. For example, if the probability of a seal failure in a single-seal design is 0.10 then the probability of having a complete sealing interface failure in a redundant-seal design using similar seals is 0.10×0.10 or 0.01, a factor of 10 improvement.

Additionally, the evaporation of solvents from the inks is slowed, maintaining their intended physical and chemical properties. This preventing changes in the quality of the printer output over time. Similarly, air gain by the ink delivery system under ideal sealing conditions is slowed, allowing for a longer print head cartridge life. Air gain by the ink delivery system in compromised sealing conditions (e.g. foreign material or molding defects are present at the sealing interface) is also reduced, allowing longer print head cartridge life. Air gain in cases where the ink delivery system is under negative pressure is reduced, and there is also a reduction in the number of failures of the ink delivery system to prime with ink as the printer is started up.

Furthermore, once ink is pulled through the ink delivery system, the face seal at the inner seal/pen tower interface becomes wetted with ink. This action provides for greater leak resistance than a similar dry seal. Lastly, once ink is pulled through the ink delivery system, the gland seal at the inner seal/manifold interface becomes wetted with ink. This provides a greater leak resistance than a similar dry seal. Additionally, the outer seal helps the inner seal to remain wetted, helps prevent it from being damaged, thus further improving the performance of the system.

While the preferred embodiments of the invention as implemented in a prototype system have been described, it will be understood by those skilled in the art to which the invention pertains that numerous modifications and changes may be made without departing from the true spirit and scope of the invention. For example, it is possible that different types of foams or other materials can be used for the individual sealing components, and it is also possible to position the individual seals in different locations. Furthermore, it may be possible to use face seals instead of radial seals or vice versa (or different types of seals altogether) in each of the embodiments described above. Additionally, although a number of materials are described as elastomer materials, other comparable types of materials could also be used without departing from the invention's broader aspects. The embodiments described herein are accordingly intended to define the scope of the invention precisely in the claims appended to and forming a part of this application.

What is claimed:

1. A modular ink jet delivery system comprising:

a print manifold including a passageway therethrough for the transfer of ink;

a pen tower removably and operatively engageable with the manifold, the pen tower including a central passageway for receiving and transferring ink from the manifold;

a retainer member, operatively connected to the manifold;

a first sealing member operatively connected to the pen tower, the first sealing member forming a first seal with the retainer member; and a second sealing member operatively connected to the retainer member, the second sealing member forming a second seal with the pen tower, wherein when the pen tower and the manifold are operatively engaged with each other, a substantially redundantly seated passageway is formed for the transfer of ink from the manifold to the pen tower, wherein the retainer member is fixedly attached to the manifold, and wherein a portion of the second sealing member interacts with the manifold to form a gland seal therebetween.

2. The modular ink jet delivery system of claim 1, wherein the first seal comprises a face seal formed between the retainer member and the first sealing member.

3. The modular ink jet delivery system of claim 2, wherein the second seal comprises a face seal formed between the pen tower and the second sealing member.

4. The modular ink jet delivery system of claim 3, wherein a portion of the first sealing member interacts with the pen tower to form a radial seal therebetween.

5. The modular ink jet delivery system of claim 4, wherein the second sealing member comprises an elastomer.

6. The modular ink jet delivery system of claim 1, wherein the second seal comprises a radial seal formed between the pen tower and the second sealing member.

7. A modular ink jet delivery system comprising:

a print manifold including a passageway therethrough for the transfer of ink;

a pen tower removably and operatively engageable with the manifold, the pen tower including a central passageway for receiving and transferring ink from the manifold;

a retainer member, operatively connected to the manifold;

a first sealing member operatively connected to the pen tower, the first sealing member forming a first seal with the retainer member; and a second sealing member operatively connected to the retainer member, the second sealing member forming a second seal with the pen tower, wherein when the pen tower and the manifold are operatively engaged with each other, a substantially redundantly sealed passageway is formed for the transfer of ink from the manifold to the pen tower, wherein the retainer member is fixedly attached to the manifold, and wherein the second sealing member comprises an elastomer washer, at least a portion of the elastomer washer fixedly positioned relative to the retainer member by a capture ring.

8. A modular ink jet delivery system comprising:

a print manifold including a passageway therethrough for the transfer of ink;

a pen tower removably and operatively engageable with the manifold, the pen tower including a central passageway for receiving and transferring ink from the manifold;

a retainer member, operatively connected to the manifold;

a first sealing member operatively connected to the pen tower, the first sealing member forming a first seal with the retainer member; and a second sealing member operatively connected to the retainer member, the second sealing member forming a second seal with the pen tower, wherein when the pen tower and the manifold are operatively engaged with each other, a substantially redundantly sealed passageway is formed for the transfer of ink to the manifold to the pen tower, wherein the retainer member is fixedly attached to the manifold, and wherein the second sealing member comprises a compliant foam disk, the compliant foam disk including an outer skin and a central bore, the central bore substantially in alignment with the passageway of the pen tower.

9. A modular ink jet delivery system comprising:

a print manifold including a passageway therethrough for the transfer of ink;

a pen tower removably and operatively engageable with the manifold, the pen tower including a central passageway for receiving and transferring ink from the manifold;

a retainer member, operatively connected to the manifold;

a first sealing member operatively connected to the pen tower, the first sealing member forming a first seal with the retainer member; and a second sealing member operatively connected to the retainer member, the second scaling member forming a second seal with the pen tower, wherein when the pen tower and the manifold are operatively engaged with each other, a substantially redundantly sealed passageway is formed for the transfer of ink from the manifold to the pen tower, wherein the retainer member is fixedly attached to the manifold, wherein the second sealing member comprises a check valve coupled to an elastomer needle, wherein when the pen tower and the manifold are operatively engaged with each other, the pen tower contacts the elastomer needle to form the second seal therebetween and the check valve is opened to permit ink flow therethrough, and wherein the pen tower includes a second check valve engaging the first check valve when the pen tower and the manifold are operatively engaged with each other and the second check valve is opened to permit ink flow therethrough.

10. An ink delivery system, comprising:

an ink reservoir;

a manifold assembly including a passageway for receiving and transferring ink from the ink reservoir, the manifold assembly comprising:

a print manifold operatively connected to the ink reservoir; and a retainer member fixedly attached to the print manifold;

a pen tower removably and operatively engageable with the manifold assembly, the pen tower including a passageway for receiving and transferring ink from the manifold assembly;

a first sealing member operatively connected to the manifold assembly, the first sealing member forming a first seal with the pen tower when the pen tower is operatively engaged to the manifold assembly; and a second sealing member operatively connected to the pen tower, the second sealing member forming a second seal with the manifold assembly when the pen tower is operatively engaged to the manifold assembly, wherein the first sealing member forms a gland seal with the manifold assembly.

* * * * *

UNITED STATES PATENT AND TRADEMARK OFFICE

CERTIFICATE OF CORRECTION

PATENT NO. : 6,648,457 B2
DATED : November 18, 2003
INVENTOR(S) : Smith et al.

It is certified that error appears in the above-identified patent and that said Letters Patent is hereby corrected as shown below:

Column 8,
Line 62, delete “scaling” and insert therefor -- sealing --.

Signed and Sealed this

Twenty-fifth Day of January, 2005

JON W. DUDAS
*Director of the United States Patent and Trademark Office*